US009937093B2

(12) United States Patent
Hammick

(10) Patent No.: US 9,937,093 B2
(45) Date of Patent: Apr. 10, 2018

(54) BEDPAN ASSEMBLY

(71) Applicant: Bonny Hammick, Land O Lakes, FL (US)

(72) Inventor: Bonny Hammick, Land O Lakes, FL (US)

( * ) Notice: Subject to any disclaimer, the term of this patent is extended or adjusted under 35 U.S.C. 154(b) by 30 days.

(21) Appl. No.: 15/176,321

(22) Filed: Jun. 8, 2016

(65) Prior Publication Data

US 2017/0354561 A1 Dec. 14, 2017

(51) Int. Cl.
*A61G 9/00* (2006.01)

(52) U.S. Cl.
CPC ..... *A61G 9/003* (2013.01)

(58) Field of Classification Search
CPC ..... A61G 9/003; A61G 9/00
USPC ..... 4/454–456
See application file for complete search history.

(56) References Cited

U.S. PATENT DOCUMENTS

| | | | |
|---|---|---|---|
| 3,084,348 | A | 4/1963 | Parker et al. |
| 3,728,744 | A | 4/1973 | Kimbro, Jr. et al. |
| 3,939,502 | A | 2/1976 | Miller |
| 4,827,540 | A | 5/1989 | Stokes |
| 5,079,788 | A | 1/1992 | Raupp |
| D450,840 | S | 11/2001 | Edmonds |
| 8,359,680 | B2 | 1/2013 | McQuary |
| 2008/0083060 | A1 | 4/2008 | Beers et al. |
| 2011/0191952 | A1 | 8/2011 | Brazier |
| 2013/0269095 | A1 | 10/2013 | Finley |

*Primary Examiner* — J. Casimer Jacyna

(57) ABSTRACT

A bedpan assembly includes a bedpan that may be placed on a bed. Thus, a bedridden user may urinate and defecate into the bedpan. A cushion is coupled to the bedpan and the cushion enhances comfort of the bedridden user. A valve is coupled to the bedpan to receive the bedridden user's urine. The valve is selectively positioned between an open position and a closed position. Thus, the valve inhibits the urine from back splashing onto the bedridden user.

7 Claims, 3 Drawing Sheets

BEDPAN ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to bedpan devices and more particularly pertains to a new bedpan device having a one-way check valve.

BRIEF SUMMARY OF THE INVENTION

An embodiment of the disclosure meets the needs presented above by generally comprising a bedpan that may be placed on a bed. Thus, a bedridden user may urinate and defecate into the bedpan. A cushion is coupled to the bedpan and the cushion enhances comfort of the bedridden user. A valve is coupled to the bedpan to receive the bedridden user's urine. The valve is selectively positioned between an open position and a closed position. Thus, the valve inhibits the urine from back splashing onto the bedridden user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
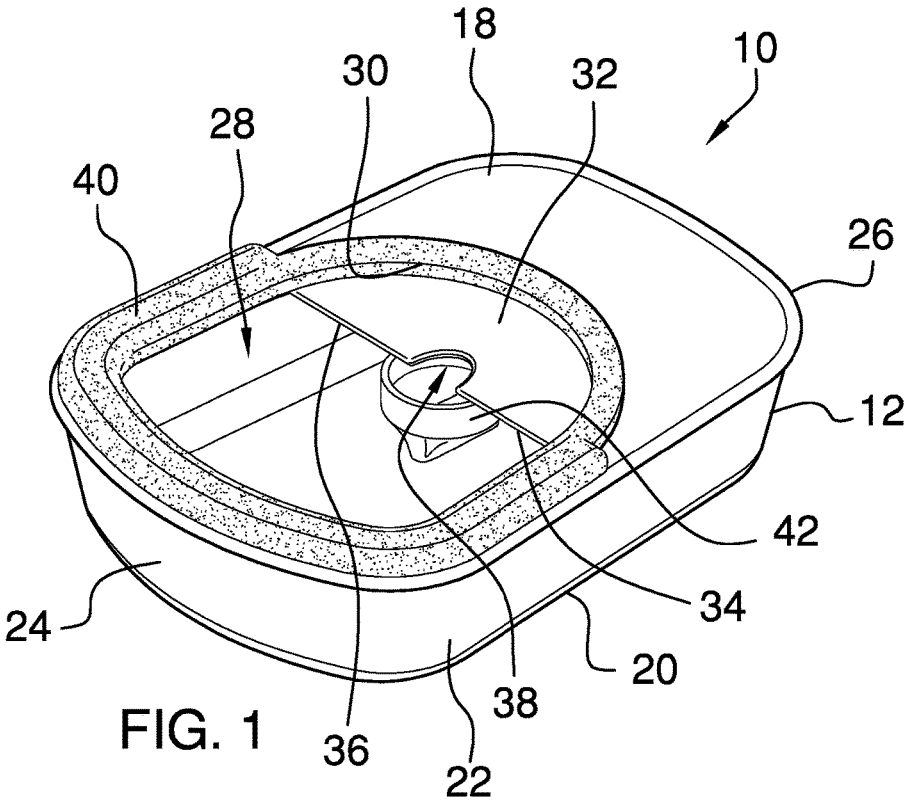
FIG. 1 is a top perspective view of a bedpan assembly according to an embodiment of the disclosure.
Figure 2:
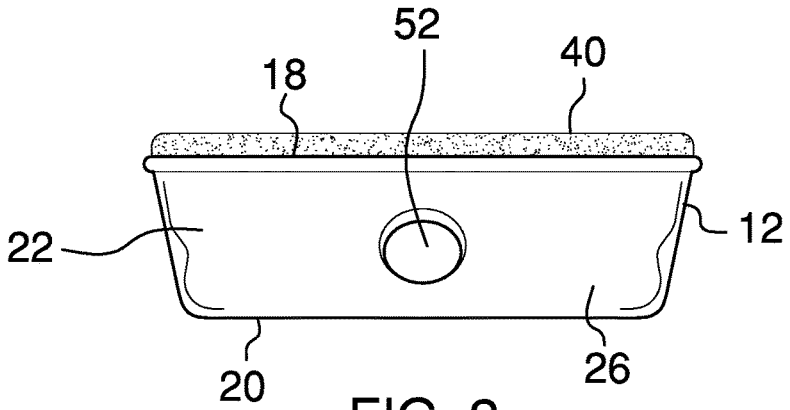
FIG. 2 is a front view of an embodiment of the disclosure.
Figure 3:
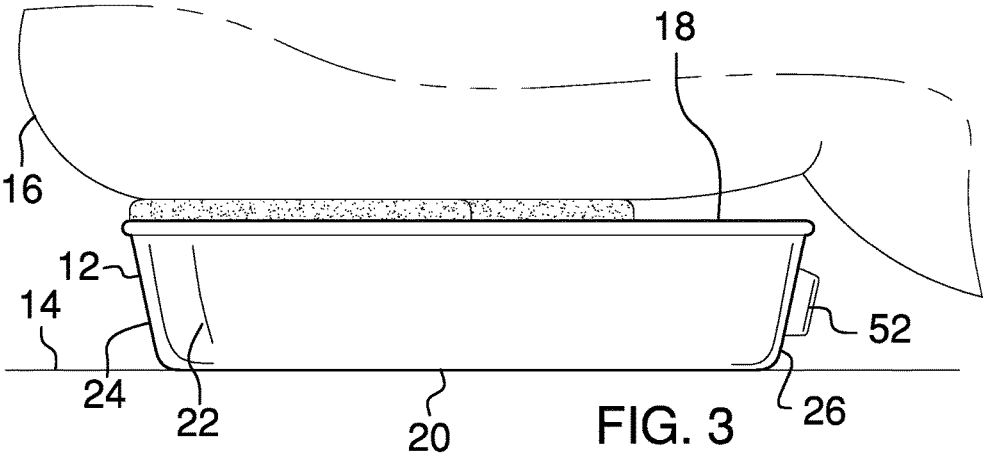
FIG. 3 is a left side view of an embodiment of the disclosure.
Figure 4:
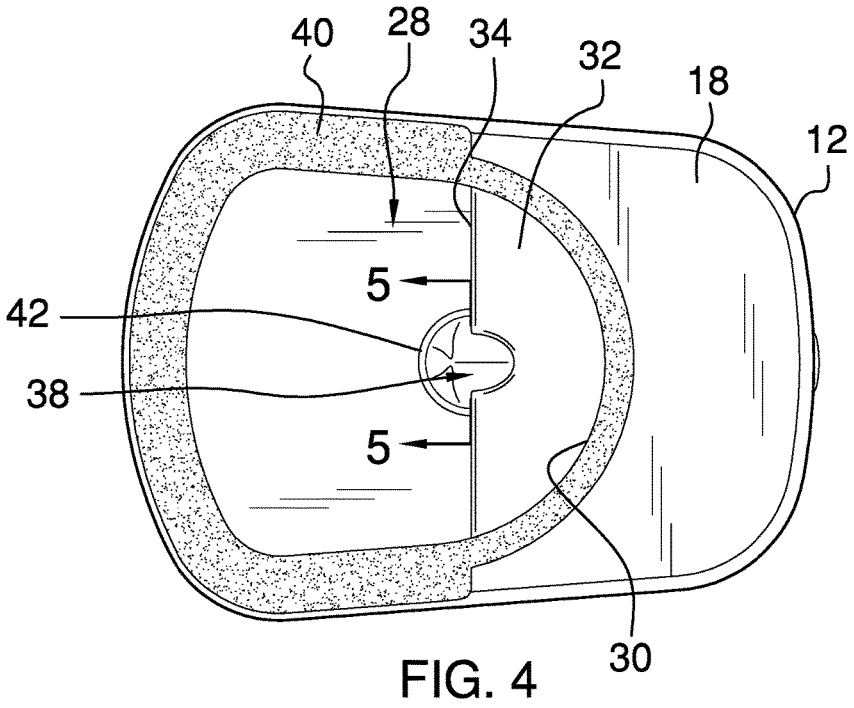
FIG. 4 is a top view of an embodiment of the disclosure.
Figure 5:
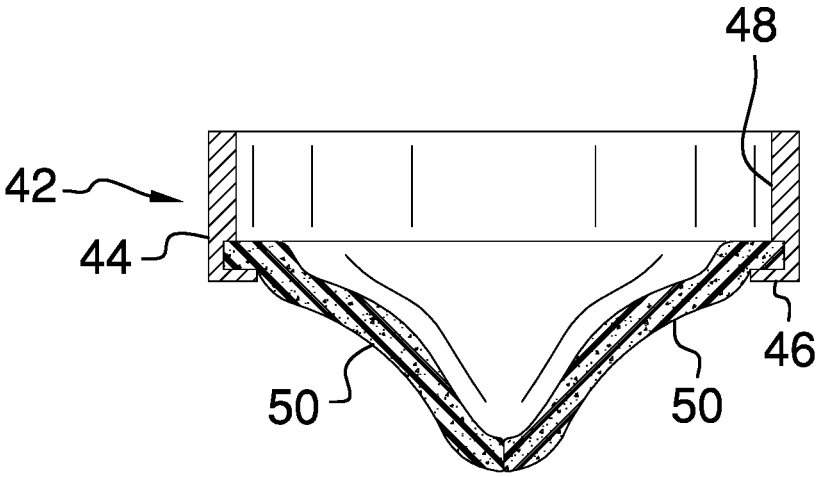
FIG. 5 is a cross sectional view taken along line 5-5 of FIG. 4 of a valve of an embodiment of the disclosure in a closed position.
Figure 6:
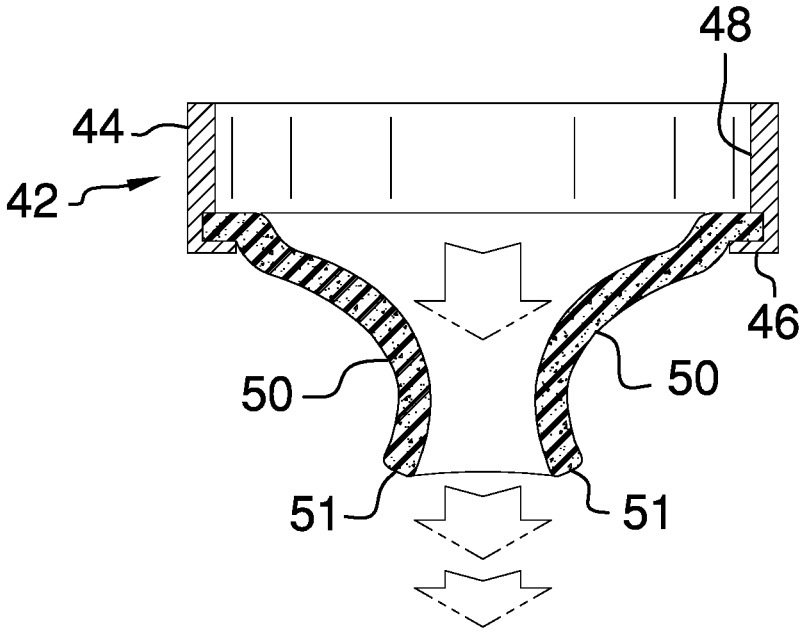
FIG. 6 is a cross sectional view taken along line 5-5 of FIG. 4 of a valve of an embodiment of the disclosure in an open position.

With reference now to the drawings, and in particular to FIGS. 1 through 6 thereof, a new bedpan device embodying the principles and concepts of an embodiment of the disclosure and generally designated by the reference numeral 10 will be described.

As best illustrated in FIGS. 1 through 6, the bedpan assembly 10 generally comprises a bedpan 12. The bedpan 12 may be placed on a bed 14 thereby facilitating a bedridden user 16 to urinate and defecate into the bedpan 12. The bedpan 12 has a top wall 18, a bottom wall 20 and a peripheral wall 22 extending therebetween. The peripheral wall 22 has a front side 24 and a back side 26. The bottom wall 20 may be placed on the bed 14 having the bedridden user 16 lying on the top wall 18.

The top wall 18 has an opening 28 extending therethrough and the opening 28 may be aligned with the bedridden user 16's genitalia. The opening 28 extends from the front side 24 toward the back side 26 and the opening 28 has a bounding edge 30. A ledge 32 is coupled to the top wall 18. The ledge 32 is positioned to extend from the bounding edge 30 toward the front side 24. Thus, the ledge 32 substantially covers the opening 28.

The ledge 32 is spaced downwardly from the bounding edge 30. The ledge 32 has a first edge 34 and a bottom surface 36. The first edge 34 has a slot 38 extending toward the bounding edge 30 of the opening 28. Thus, the slot 38 may be aligned with the bedridden user 16's genitalia. The slot 38 is centrally positioned on the first edge 34.

A cushion 40 is provided. The cushion 40 coupled to the bedpan 12 and the cushion 40 may enhance comfort of the bedridden user 16. The cushion 40 is coupled to the bounding edge 30 and the cushion 40 is coextensive with the bounding edge 30. The cushion may be comprised of a resiliently compressible material. Thus, the cushion 40 may inhibit the bedridden user 16 from developing pressure ulcers or the like.

A valve 42 is provided. The valve 42 is coupled to the bedpan 12 and the valve 42 may receive the bedridden user 16's urine. The valve 42 is selectively positioned between an open position and a closed position. Thus, the valve 42 inhibits the urine from back splashing onto the bedridden user 16.

The valve 42 includes a ring 44. The ring 44 is coupled to the bottom surface 36 of the ledge 32. The ring 44 is positioned to surround the slot 38 in the ledge 32. The ring 44 has a distal edge 46 with respect to the bottom surface 36 and an inner surface 48.

A pair of flaps 50 is provided each of the flaps 50 is coupled to the inner surface 48. Each of the flaps 50 is substantially coextensive with the distal edge 46 of the ring 44. Each of the flaps 50 extends downwardly from the ring 44. Thus, each of the flaps 50 has a distal edge 51 with respect to the ring 44.

The distal edge 51 corresponding to each of the flaps 50 is biased to abut one another. Thus, the pair of flaps 50 inhibits urine in the bedpan 12 from passing upwardly through the valve 42. Each of the flaps 50 is comprised of a deformable material. The distal edge 46 corresponding to each of the flaps 50 may be urged apart from each other by weigh of the bedridden user 16's urine. Thus, the bedridden user 16's urine may pass through the valve 42.

A drain 52 is provided and the drain may be manipulated. The drain 52 extends through the bedpan 12 and the drain 52 may selectively drain the bedridden user 16's urine from the bedpan 12. The drain 52 is positioned on the back side 26. The drain may comprise a fluid drain of any conventional design.

In use, the bedpan 12 is positioned on the bed 14 and the bedridden user 16 is positioned on the bedpan 12. The bedridden user 16 is positioned to facilitate the bedridden user 16 to urinate into the valve 42. Moreover, the bedridden user 16 may defecate into the opening 28. The weight of the bedridden user's urine forces the flaps 50 apart from each other. Thus, the valve 42 allows the urine to flow into the bedpan 12. The distal edge 51 corresponding to each of the flaps 50 is biased together when the urine is drained from the valve 42. Thus, the valve 42 inhibits the urine from back splashing on the bedridden user 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bedpan assembly comprising:

a bedpan being configured to be placed on a bed thereby facilitating a bedridden user to urinate and defecate into said bedpan, said bedpan having a top wall, a bottom wall and a peripheral wall extending therebetween, said peripheral wall having a front side and a back side, said bottom wall being configured to be placed on the bed having the bedridden user lying on said top wall, said top wall having an opening extending therethrough wherein said opening is configured to be aligned with the bedridden user's genitalia, said opening extending from said front side toward said back side, said opening having a bounding edge, said bedpan including a ledge being coupled to said top wall, said ledge being positioned to extend from said bounding edge toward said front side such that said ledge substantially covers said opening, said ledge being spaced downwardly from said bounding edge, said ledge having a first edge and a bottom surface, said first edge having a slot extending toward said bounding edge of said opening wherein said slot is configured to be aligned with the bedridden user's genitalia, said slot being centrally positioned on said first edge;

a cushion being coupled to said bedpan wherein said cushion is configured to enhance comfort of the bedridden user; and a one way check valve being coupled to said bedpan wherein said valve is configured to receive the bedridden user's urine, said one way check valve being selectively positioned between an open position and a closed position wherein said one way check valve is configured to inhibit the urine from back splashing onto the bedridden user.

2. The assembly according to claim 1, wherein said cushion is coupled to said bounding edge, said cushion being coextensive with said bounding edge.

3. A bedpan assembly comprising:

a bedpan being configured to be placed on a bed thereby facilitating a bedridden user to urinate and defecate into said bedpan;

a cushion being coupled to said bedpan wherein said cushion is configured to enhance comfort of the bedridden user; and a one way check valve being coupled to said bedpan wherein said valve is configured to receive the bedridden user's urine, said one way check valve being selectively positioned between an open position and a closed position wherein said one way check valve is configured to inhibit the urine from back splashing onto the bedridden user;

said bedpan includes a ledge, said ledge having a bottom surface and a slot; and said one way check valve comprises a ring being coupled to said bottom surface of said ledge, said ring being positioned to surround said slot in said ledge, said ring having a distal edge with respect to said bottom surface and an inner surface.

4. The assembly according to claim 3, further comprising a pair of flaps, each of said flaps being coupled to said inner surface, each of said flaps being substantially coextensive with said distal edge of said ring, each of said flaps extending downwardly from said ring such that each of said flaps has a distal edge with respect to said ring, said distal edge corresponding to each of said flaps being biased to abut one another wherein said pair of flaps is configured to inhibit urine in the bedpan from passing upwardly through said one way check valve.

5. The assembly according to claim 4, wherein each of said flaps is comprised of a deformable material wherein said distal edge corresponding to each of said flaps is configured to be urged apart from each other by the bedridden user's urine thereby facilitating the bedridden user's urine to pass through said one way check valve.

6. The assembly according to claim 1, further comprising a drain extending through said bedpan wherein said drain is configured to selectively drain the bedridden user's urine from said bedpan, said drain being positioned on said back side.

7. A bedpan assembly comprising:

a bedpan being configured to be placed on a bed thereby facilitating a bedridden user to urinate and defecate into said bedpan, said bedpan having a top wall, a bottom wall and a peripheral wall extending therebetween, said peripheral wall having a front side and a back side, said bottom wall being configured to be placed on the bed having the bedridden user lying on said top wall, said top wall having an opening extending therethrough wherein said opening is configured to be aligned with the bedridden user's genitalia, said opening extending from said front side toward said back side, said opening having a bounding edge, said bedpan including a ledge being coupled to said top wall, said ledge being positioned to extend from said bounding edge toward said front side such that said ledge substantially covers said opening, said ledge being spaced downwardly from said bounding edge, said ledge having a first edge and a bottom surface, said first edge having a slot extending toward said bounding edge of said opening wherein said slot is configured to be aligned with the bedridden user's genitalia, said slot being centrally positioned on said first edge;

a cushion being coupled to said bedpan wherein said cushion is configured to enhance comfort of the bedridden user, said cushion being coupled to said bounding edge, said cushion being coextensive with said bounding edge; and a one way check valve being coupled to said bedpan wherein said one way check valve is configured to receive the bedridden user's urine, said valve being selectively positioned between an open position and a closed position wherein said one way check valve is configured to inhibit the urine from back splashing onto the bedridden user, said one way check valve comprising:

a ring being coupled to said bottom surface of said ledge, said ring being positioned to surround said slot in said ledge, said ring having a distal edge with respect to said bottom surface and an inner surface, and a pair of flaps, each of said flaps being coupled to said inner surface, each of said flaps being substantially coextensive with said distal edge of said ring, each of said flaps extending downwardly from said ring such that each of said flaps has a distal edge with respect to said ring, said distal edge corresponding to each of said flaps being biased to abut one another wherein said pair of flaps is configured to inhibit urine in the bedpan from passing upwardly through said valve, each of said flaps being comprised of a deformable material wherein said distal edge corresponding to each of said flaps is configured to be urged apart from each other by the bedridden user's urine thereby facilitating the bedridden user's urine to pass through said one way check valve; and a drain extending through said bedpan wherein said drain is configured to selectively drain the bedridden user's urine from said bedpan, said drain being positioned on said back side.

* * * * *